United States Patent [19]

Knox et al.

[11] 4,118,833

[45] Oct. 10, 1978

[54] BUCKLE ASSEMBLY WITH STRAP TIGHTENING MECHANISM

[75] Inventors: Howard T. Knox, Simi; Ernest Prete, Jr., Woodland Hills, both of Calif.

[73] Assignee: Ancra Corporation, El Segundo, Calif.

[21] Appl. No.: 805,004

[22] Filed: Jun. 9, 1977

[51] Int. Cl.[2] ..... A44B 21/00

[52] U.S. Cl. ..... 24/68 CD; 248/499

[58] Field of Search ..... 24/68 R, 68 CD, 68 SB, 24/68 E, 68 J, 70 ST, 70 TD, 163 R, 168–171, 191, 197; 248/499, 500

[56] References Cited

U.S. PATENT DOCUMENTS

| | | | |
|---|---|---|---|
| 2,852,827 | 9/1958 | Arnold | 24/68 CD |
| 3,641,630 | 2/1972 | Farley | 24/68 CD |
| 3,703,024 | 11/1972 | Johnson | 24/68 CD |
| 3,866,272 | 2/1975 | Prete et al. | 24/68 CD |

FOREIGN PATENT DOCUMENTS

| | | | |
|---|---|---|---|
| 686,720 | 3/1965 | Italy | 24/68 J |

*Primary Examiner*—Louis K. Rimrodt
*Attorney, Agent, or Firm*—Edward A. Sokolski

[57] ABSTRACT

A buckle assembly includes a main frame which is generally U-shaped and has a pair of parallel opposing side plates and a bottom formed by a plurality of cross-bars. Pivotally mounted on the main frame is a strap-tightening handle which is utilized to tighten a strap and to retain it in the tightened position. This handle includes a tightening cross-bar around which the strap is looped, and the two opposite ends of such strap then run under one of the cross-bars of the main frame. A limit stop member is provided in at least one of the side arms of the frame to limit the downward travel of the handle in its strap-tightening position. This assembly is further adapted to be locked in position in conjunction with a security locking device such as a padlock.

2 Claims, 9 Drawing Figures

BUCKLE ASSEMBLY WITH STRAP TIGHTENING MECHANISM

This invention relates to a buckle for use in tightening a strap and retaining such strap in a tightened position, and more particularly to such a device suitable for use in conjunction with tie-down straps for cargo and the like.

In U.S. Pat. No. 3,641,630, a strap-tightening buckle is described for tightening a strap or a belt and retaining the strap in this tightened position in securing cargo and the like. This buckle employs a frame member on which a lever or handle is pivotally supported, the strap being looped around a cross-bar of the handle and passed under a cross-bar of the frame so that when the handle is brought down against the frame, the strap is tightened and retained in its tightened position. The present invention is an improvement on the buckle of the aforementioned patent.

Among these improvements are the following: First, means are provided in the present invention to limit the downward motion of the handle in its tightened latched position so as to avoid jamming of the webbing between the handle and the frame and to afford precise alignment of holes in the handle and the frame through which the security locking device passes. Secondly, means are provided for a security locking device such as a padlock to be used in conjunction with the buckle so that the buckle can be security locked in its tightened position. These and other features of the present invention make for significant improvement in operation which will be apparent as the description proceeds in connection with the accompanying drawings, of which:

Figure 1:
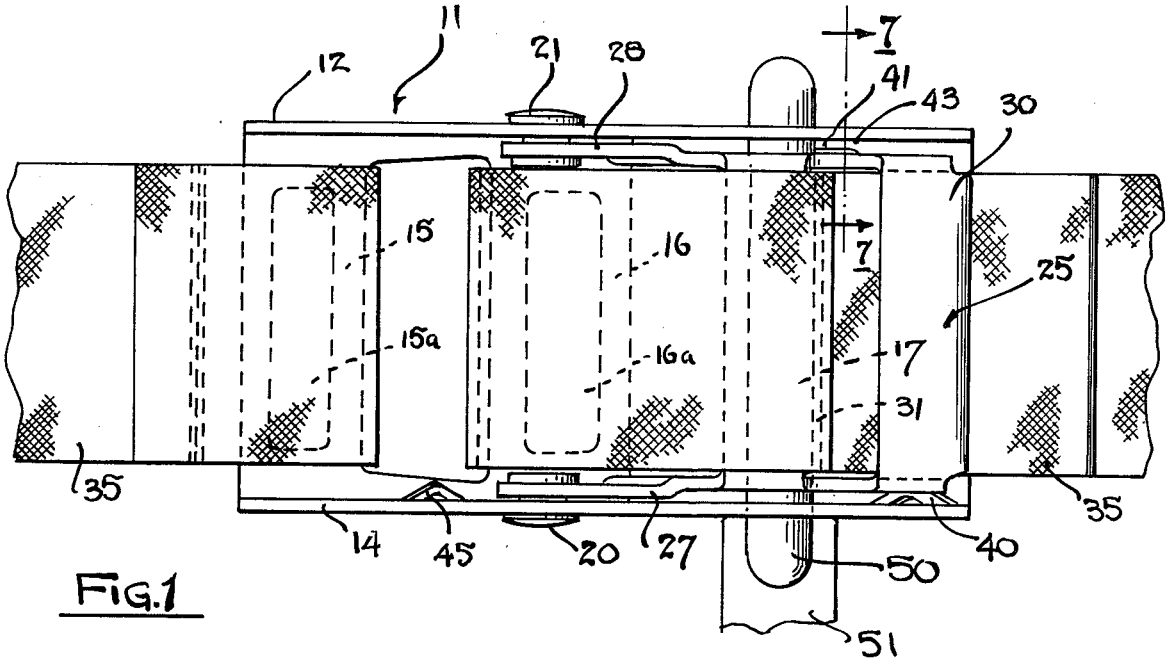
FIG. 1 is a top plan view of a preferred embodiment of the invention.
Figure 2:
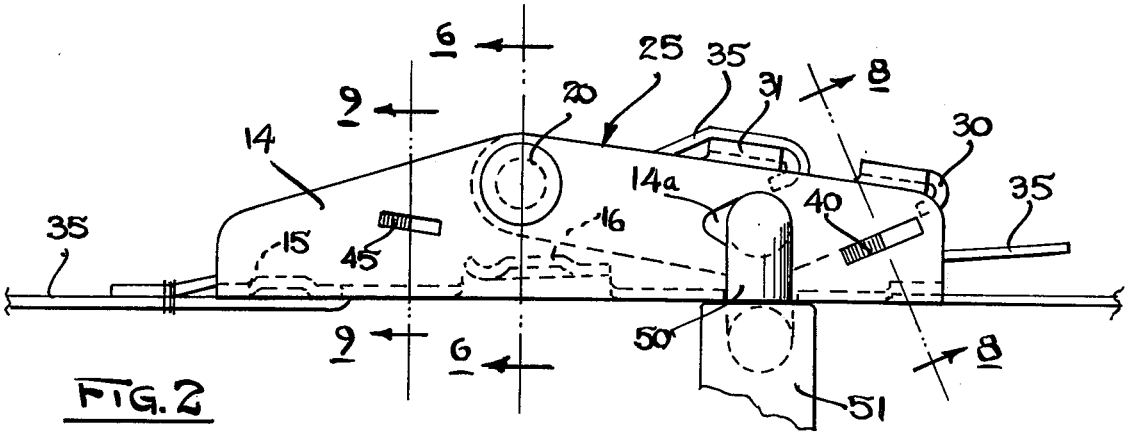
FIG. 2 is a side elevational view of the preferred embodiment.
Figure 3:
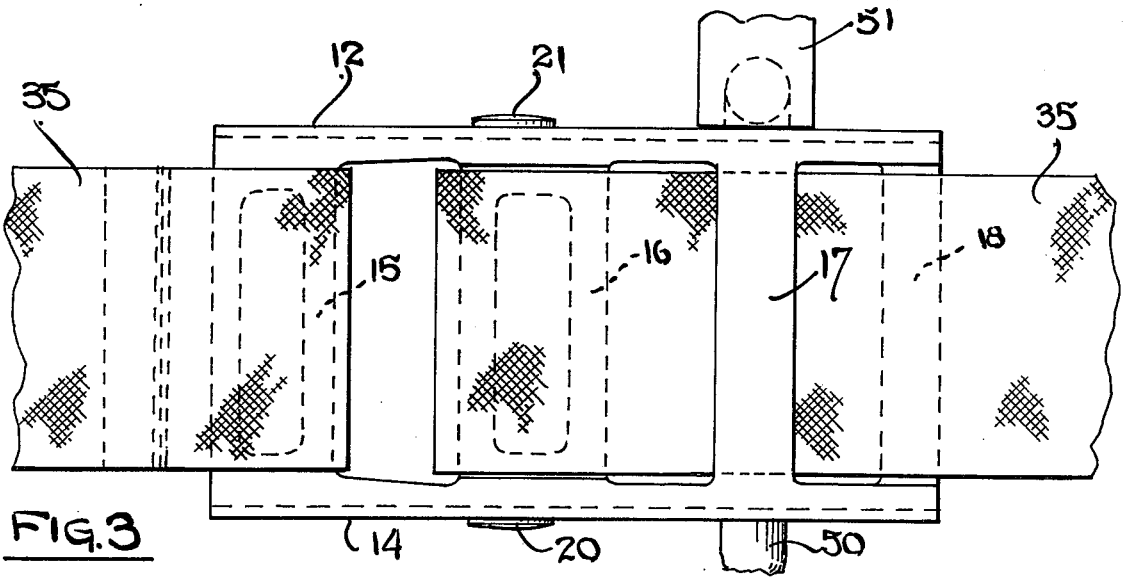
FIG. 3 is a bottom plan view of the preferred embodiment.
Figure 4:
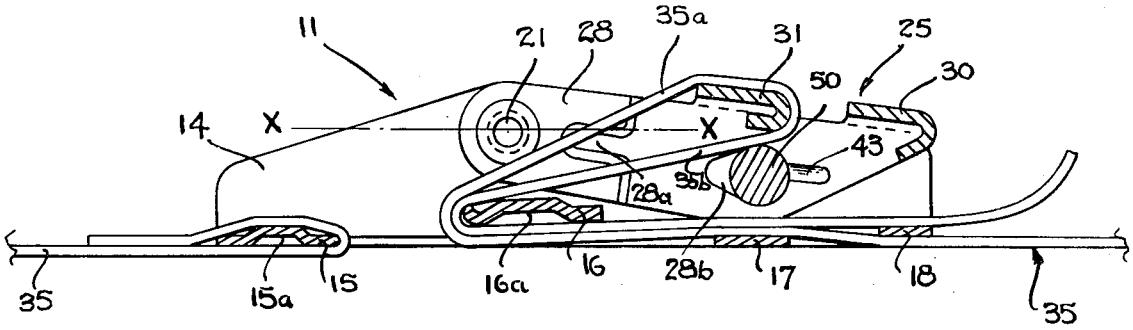
FIG. 4 is an elevational view in cross-section of the preferred embodiment.

Briefly described, the device of my invention is as follows: A main frame member which is generally U-shaped has a pair of flat opposing sides which are joined together by a plurality of cross-bars. Pivotally supported between the sides by means of pivot pins or the like is a handle member which has a pair of side arms which are joined together by a pair of cross-bars. A strap to be tightened and held in a tightened position by the buckle is looped around the inner cross-bar of the handle which may be referred to as a tightening bar, and the free ends of the strap are then run under one of the cross-bars of the main frame which is located approximately in the center thereof, and brought out from the buckle. The strap is then tightened and retained in the tightened position by rotating the handle to a downward position between the sides of the main frame, where it is latched in position. Stop means is provided on the main frame to limit the downward motion of the handle so as to avoid jamming of the strap between the handle and the frame. Further, aligned apertures are provided in the frame and handle through which a padlock bar can be placed for security locking the buckle in the tightened position.

Referring now to the Figures, a preferred embodiment of the invention is illustrated. Main frame 11 has a pair of side walls 12 and 14 which are joined together by cross-bars 15, 16, 17 and 18. Cross-bars 15 and 16 have indents **15*a* and 16*a* respectively formed therein for stiffening. The cross-bars 15–18 form a bottom for the main frame. Pivotally mounted on the side walls 12 and 14 of the main frame by means of pivot pins 20 and 21 is handle member 25, which has a pair of side arms 27 and 28 and cross-bars 30 and 31 which join the side arms together. Side arms 27 and 28 each have respective indentations 27*a* and 28*a*** formed therein which act as stiffeners.

Figure 5:
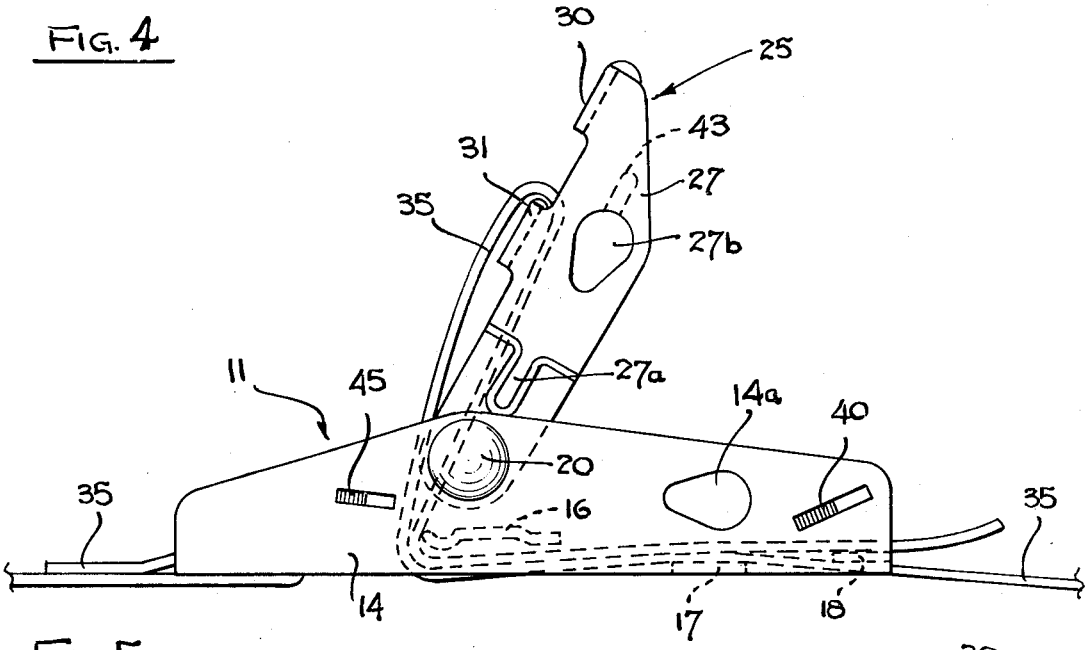
FIG. 5 is an elevational view of the preferred embodiment showing the handle in an upward position.
Figure 9:
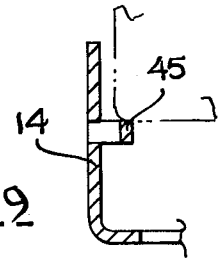
FIG. 9 is a cross-sectional view of the preferred embodiment taken along the plane indicated by 9—9 in FIG. 2.
Figure 8:
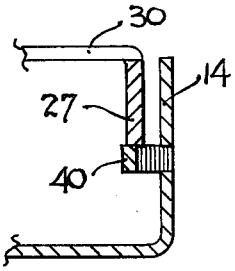
FIG. 8 is a cross-sectional view taken along the plane indicated by 8—8 in FIG. 2.
Figure 6:
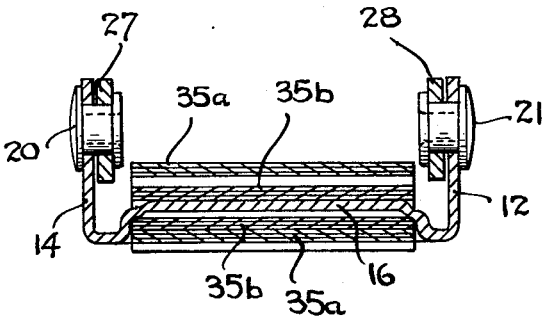
FIG. 6 is a cross-sectional view of the preferred embodiment taken along the plane indicated by 6—6 in FIG. 2.
Figure 7:
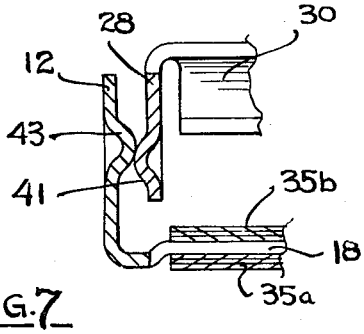
FIG. 7 is a cross-sectional view of the preferred embodiment taken along the plane indicated by 7—7 in FIG. 1.

A strap or belt 35 is wrapped around cross-bar 31 of handle 25 and the two legs **35*a* and 35*b* thereof then drawn around cross-bar 16 of the main frame, these two strap legs then being drawn over cross-bar 17 and finally leg 35*b* being drawn over cross-bar 18 and strap leg 35*a* being drawn under this bar. The device is shown with the handle in a strap-release position in FIG. 5. As can be seen in the remaining Figures, the strap is tightened and secured in the tightened position by pressing cross-bar 30 down towards frame 11, the resultant downward travel of the handle being stopped by virtue of the abutment of an edge of side arm 27 against projection 40 formed in side wall 14 of the main frame, as can best be seen in FIG. 8. The handle is latched in position against side wall 12 by virtue of projection 41 formed in arm 28 riding over projection 43 formed in side wall 12 to the position on the under side of projection 43, as shown in FIG. 7. The handle is thus latched in position and prevented from traveling beyond stop 40 so as to avoid the likelihood of strap 35 becoming jammed between the handle and the main frame. Backward travel of handle 25 is limited by means of stop projection 45 formed in side wall 14, which as can be seen from FIG. 9 is in the path of side arm 27** and prevents movement of the handle once this side arm strikes the projection. This operates to prevent jamming of the belt on extreme rearward motion of the handle.

A significant feature of the present invention is the provision of similar apertures **27*b* and 28*b* in side arms 27 and 28 respectively, which mate with corresponding aperture 14*a* in side wall 14 of the frame and a corresponding aperture (not shown) in side wall 12. With the handle in the latched tightening position, these corresponding apertures are aligned with each other and the bar 50 of a security locking member, such as a padlock, 51 is fitted therethrough as shown in FIGS. 1–4. In this manner, the device can be security-locked in the tightened latched condition so as to prevent the opening of the buckle and the release of the strap. The other end of strap 35 is looped around cross-bar 15** and permanently attached thereto as, for example, by stitching together the overlapping pieces thereof.

In the latched condition, cross-bar 31 of the handle and cross-bar 16 of the frame are on opposite sides of an axial plane X—X of pivots 20 and 21, which is substantially parallel to the frame base formed by cross-bars 15–18.

While the invention has been described and illustrated in detail, it is to be clearly understood that this is intended by way of illustration and example only and is not to be taken by way of limitation, the spirit and scope of this invention being limited only by the terms of the following claims.

We claim:

1. In a buckle for tightening a strap having a generally U-shaped main frame member with a pair of opposing side walls joined together by a plurality of cross-bars forming a bottom, one of which is centrally located and another of which is at one end of said frame member, and a handle member pivotally supported between the sides of said frame member and having a pair of side arms joined together by an inner and outer cross-bar, one end of the strap being looped around the inner cross-bar of the handle with the two legs of the loop being drawn under the centrally located cross bar of the frame member and out from the buckle, the other end of the strap being attached to the cross bar at said one end of said frame member, the improvement comprising:

means for stopping the downward travel of said handle and latching said handle at a predetermined position spaced from the bottom of said frame member comprising a projection formed in one of the side walls of said frame member and extending inwardly therefrom, a projection on one of said handle side arms and a projection on the other of said frame member side walls whereby in the latched position the bottom edge of the other of said handle side arms abuts against said frame member side wall projection with the projection on the other of said handle said arms abutting against the under side of the projection on the other of said frame member side walls, similar apertures formed in each of the side walls of the main frame member and the side arms of said handle member, said apertures being aligned with each other with the handle in said predetermined latched position, and security means for locking said handle in the latched position including a bar fitted through said apertures.

2. The buckle of claim 1 wherein said security means comprises a padlock, the locking bar of which is fitted through said apertures.

* * * * *